United States Patent [19]

Rongus et al.

[11] Patent Number: 4,594,944

[45] Date of Patent: Jun. 17, 1986

[54] SETTING RING SYSTEM FOR ELECTRONIC TIME FUZING

[75] Inventors: Leo P. Rongus, Takoma Park; David L. Overman; Robert N. Johnson, both of Silver Spring, all of Md.

[73] Assignee: United States of America as represented by the Secretary of the Army, Washington, D.C.

[21] Appl. No.: 635,011

[22] Filed: Jul. 27, 1984

[51] Int. Cl.[4] ..... F42C 17/00

[52] U.S. Cl. ..... 102/221; 89/6; 102/264; 102/270; 102/271

[58] Field of Search ..... 102/221, 200, 206, 262, 102/264, 270, 271, 257; 89/6, 6.5

[56] References Cited

U.S. PATENT DOCUMENTS

| | | | |
|---|---|---|---|
| 911,845 | 2/1909 | Schwartz et al. | 89/6 |
| 1,511,622 | 10/1924 | Lucas | 89/6 X |
| 2,351,743 | 6/1944 | Chappell et al. | 89/6 |
| 2,531,488 | 11/1950 | Wolf | 89/6 X |
| 3,286,632 | 11/1966 | Potts et al. | 102/270 X |
| 3,699,892 | 10/1972 | Kopec et al. | 102/264 X |
| 3,824,889 | 7/1974 | Kaiser et al. | 89/6 |
| 4,188,885 | 2/1980 | Wolf et al. | 102/221 |

OTHER PUBLICATIONS

Engineering Design Handbook—Ammunition Series Fuzes AMC Pamphlet AMCP 706-210 USAMAC, Nov. 1969, pp. 2-6 & 2-7.

*Primary Examiner*—David H. Brown

*Attorney, Agent, or Firm*—Saul Elbaum; Thomas E. McDonald; Anthony T. Lane

[57] ABSTRACT

A system for manually setting a timing value of an electronic fuze for an artillery projectile prior to firing without tools or electric power, and for displaying the set timing value in standard decimal format. Two adjacent setting rings, disposed about the outside of the fuze housing, are interconnected together with the housing so that one ring rotates with the other ring when the other ring is manually rotated in one direction about the housing axis, but is prevented from rotating when the other ring is rotated in an opposite direction about the housing axis. Each ring carries a plurality of numbers disposed about its outer periphery such that one of the numbers is axially aligned with an indication mark on the fuze housing at each setting of the ring. The two series of numbers are oriented laterally so that the two numbers aligned with the indication mark constitute the desired timing value. Also these two series of numbers are selected so that the indicated timing value can be manually adjusted in equal time increments from a minimum value to a maximum value, with the total number of selectable timing values being equal to the number of settings of one ring times the number of settings of the other ring. Each ring actuates a ring-type membrane switch assembly disposed between the ring and the fuze housing to encode a multi-bit code to the electronic fuze corresponding the indicated number of that ring.

7 Claims, 3 Drawing Figures

SETTING RING SYSTEM FOR ELECTRONIC TIME FUZING

RIGHTS OF THE GOVERNMENT

The invention described herein may be manufactured, used, and licensed by or for the United States Government for governmental purposes without payment to us of any royalty thereon.

BACKGROUND OF THE INVENTION

The invention relates generally to numerical encoding devices for electronic circuits, and, in particular, to a setting ring system of an electronic artillery fuze for setting and displaying a time value encoded to the fuze.

Several types of fuzes used on artillery munitions require the setting of an event time prior to firing. The fuze setting time system must be a rugged, compact system, in which the time value can be accurately set and displayed, without the use of tools or electric power. In the past, this has often been done by turning the fuze nose relative to markings on the fuze body. In such a system, the number of possible time settings is limited by the requirement that the selected time setting be legibly displayed on an exterior surface of the fuze.

OBJECTS AND SUMMARY OF THE INVENTION

It is an object of the invention to provide a simple, compact, rugged system for setting displaying a time value to be encoded to an electronic artillery fuze, without requiring the use of tools or electric power.

It is a further object of the invention to provide such a setting system for an electronic artillery fuze, in which the selected time value is displayed as a discrete, readable number, in standard decimal format, on the exterior surface of the fuze.

Since the housing of an electronic fuze for an artillery projectile also serves as the nose of the projectile, it has an external surface which extends symmetrically about the axis of the projectile. In the present invention, this external surface of the fuze housing includes a recess or groove, in which two settng rings are disposed so that the outer surface of these rings are substantially flush with the adjacent housing surface. Each of these rings is manually rotatable about the housing axis against a restraining force to a plurality of predetermined positions or settings. This restraining force is provided by an O-ring of resilient material which is disposed between one side of the annular groove and an adjacent side of a first one of the setting rings. This O-ring exerts an axial force on the two rings to cause the first ring to engage the second ring along adjacent sides, and the second ring to engage the other side of the housing groove.

The engaging sides of the second ring and the housing groove are formed as buttress and ramp shaped teeth, to allow the rotation of the second ring in only a first direction of rotation relative to the housing. Similarly, the engaging sides of the first and second rings are formed as buttress and ramp shaped teeth to allow the rotation of the first ring in only an opposite second direction of rotation relative to the second ring. With this arrangement, only the first ring needs to be manually rotated to select the desired settings of both rings. For this reason, the outer portion of the first ring is made much wider than that of the second ring, to thus make it easier to select the desired settings of these rings.

The fuze housing includes an indication mark adjacent the two setting rings for indicating the selected time value to be encoded to the fuze. The outer surface of each of the two setting rings includes a plurality of numbers in standard digital format corresponding in number to the number of settings of that ring. These numbers are disposed about the rings so that one of these numbers is axially aligned with the housing indication mark at each setting of the ring. Also, the numbers on one ring are disposed relative to the numbers on the other ring so that, at each combination of settings of the two rings, the two numbers adjacent the indication mark can be read as a single numerical value of timing units, e.g., seconds, indicating the timing value to be encoded to the fuze.

The setting ring carrying the more significant portion of the indicated numerical value, that is, the ring whose numbers are disposed to the right of the numbers on the other ring, can be rotated to vary the setting of this number from a minimum number to a maximum number in equal first increments of one. Similarly, the other ring carrying the less significant portion of the indicated numerical value can be rotated to vary its number from 0 to a maximum number in equal second increments such that the indicated numerical value can be adjusted in equal increments from a minimum value to a maximum value, with the total number of selectable numerical values being equal to the number of first ring settings times the number of second rings settings. To accomplish this, the first increment of one, when read as an increment of the indicated numerical value, must be equal to the second increment times the number of settings of the ring carrying the numbers which correspond to the less significant portion of the indicated numerical value. Also, each number (other than 0) of the more significant portion of the numerical value, when read as the numerical value, is a multiple of the second increment. For example, if it is assumed that the time value encoded to the fuze should be variable in steps of one half second from 0 to approximately 200 seconds, both of the rings could have 20 settings, with the left ring (more significant portion) carrying a series of numbers which vary in equal increments of one from 0 to 19, and with the right ring (less significant portion) carrying a series of numbers which vary in equal increments of 0.5 from 0 to 9.5. In such a system, the time value to be encoded to the fuze can be varied from zero to 199.5 seconds in equal increments of 0.5 seconds.

The timing value displayed on the two rings adjacent the indication mark are encoded to the fuze by two ring-type coded membrane switch assemblies which are disposed on the housing beneath the two setting rings and are respectively actuated by inwardly-projecting, vertical bar members mounted on the inside of each setting ring. At each combination of settings of the two rings, the bar member of each ring depresses the membrane switches adjacent the bar member to encode a multi-bit code to the fuze corresponding to the displayed number carried by that ring. During operation of the fuze, the two multi-bit codes are processed in the electronic fuze to provide a time delay corresponding to the displayed time setting, that is, a time delay which is equal, in seconds, to the displayed right ring number plus the delayed left ring number times the product of the second increment and the number of right ring settings. (this product will always be 10 or a multiple of 10). For instance, in the example described above, when the fuze is operational and the displayed time setting is 142.5 seconds, the multi-bit code corresponding to the displayed right ring number 2.5 wil be processed to produce a time delay of 2.5 seconds and the multi-bit code corresponding to the displayed left ring number 14 will be processed to produce an additional time delay at $14\times(0.5\times20)$ or 140 seconds, for a total time delay of 142.5 seconds.

BRIEF DESCRIPTION OF THE DRAWINGS

The invention will be better understood, and further objects, features and advantages thereof will become more apparent from the following description of a preferred embodiment, taken in conjunction with the accompanying drawings in which.

DESCRIPTION OF A PREFERRED EMBODIMENT

Figure 1:
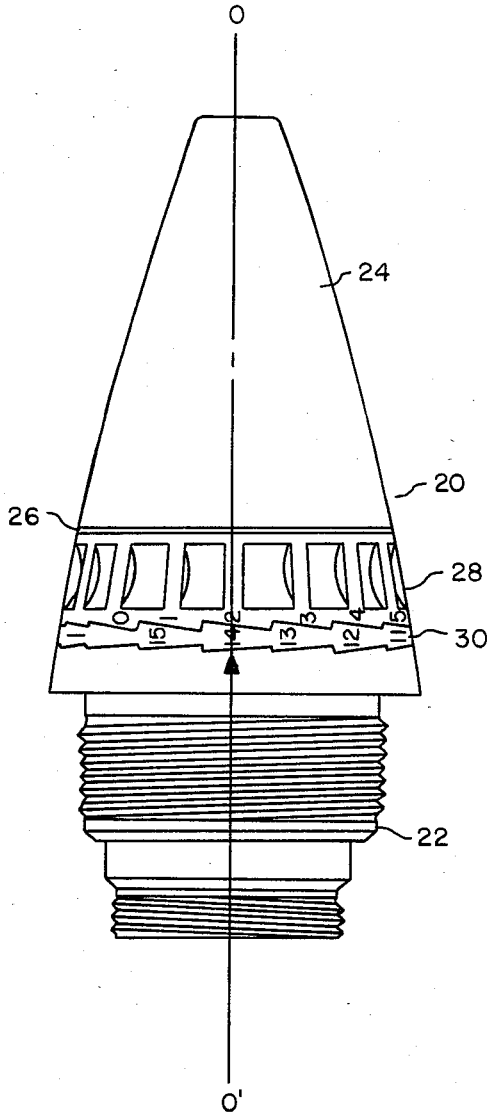
FIG. 1 is a side view of an artillery fuze, having time setting rings in accordance with the invention.
Figure 2:
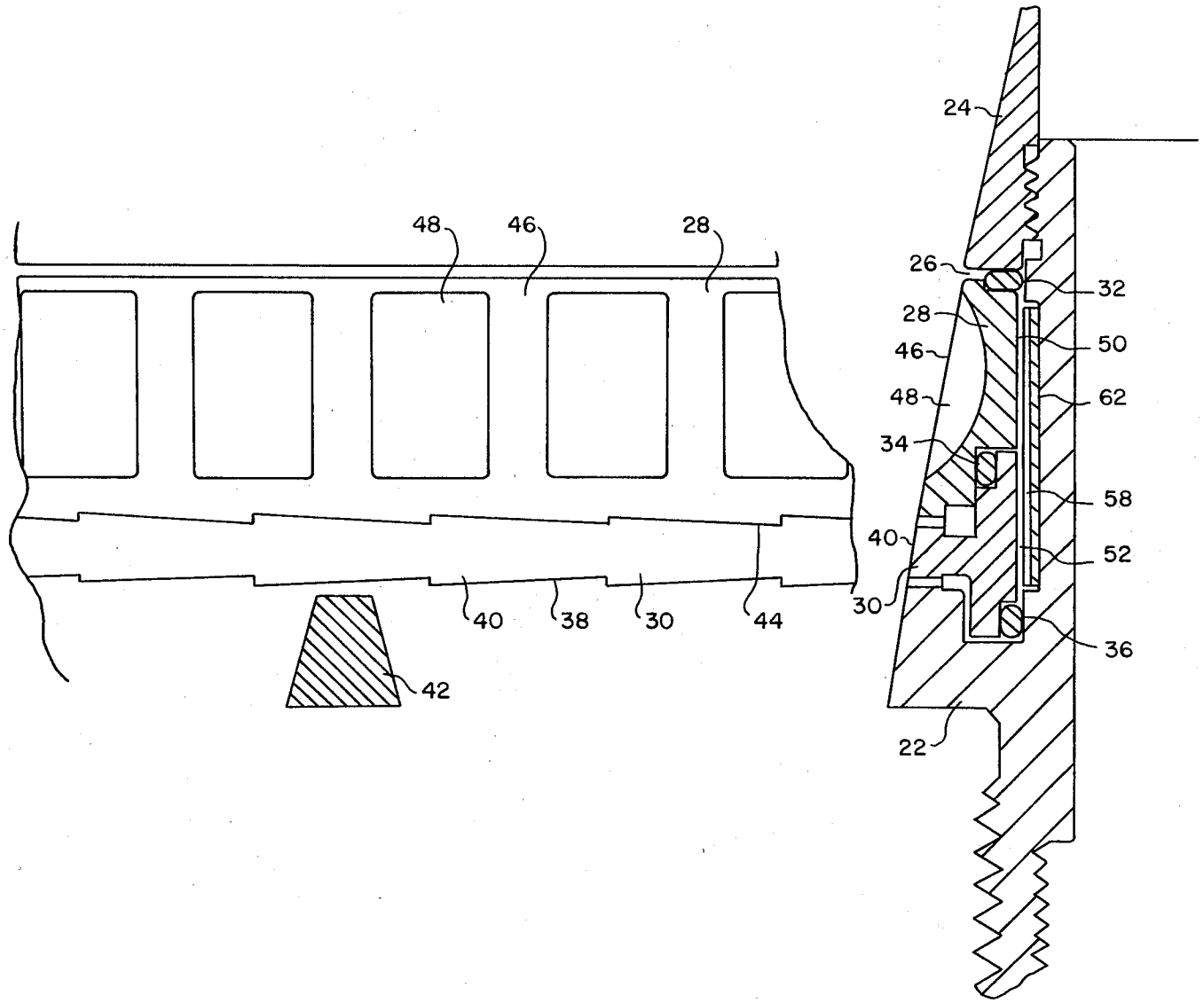
FIG. 2 shows a partial front view and a cross sectional view of the time setting rings of the fuze shown in FIG. 1.

The artillery fuze shown in FIG. 1 includes a housing 20 which includes a lower portion 22 and an upper portion 24. The housing lower portion 22 is threadedly engaged with the top end of an artillery projectile (not shown), and the housing top portion 24 is threadedly engaged with the housing lower portion 22 to define an annular recess 26 extending about the housing 20, as shown in FIG. 2. Two setting rings 28, 30 are disposed in the annular recess 26 so as to be continuously rotatable in at least one direction of rotation about the axis O–O′ of the housing 20. The inner portion of the annular recess 26 is sealed by three rubber O-rings 32, 34, 36, which are disposed respectively between the housing 20 and the upper ring 28, between the upper and lower rings 28, 30, and between the lower ring 30 and the housing 20. In addition to its sealing function, the O-ring 32 also exerts an axially-downward force against the two rings 28, 30 to maintain the upper ring 28 in contact with the lower ring 30, and to maintain the lower ring 30 in contact with the housing 20. The lower ring 30 is interconnected with the housing 20 by a set of buttress and ramp shaped teeth 38 which are disposed on adjacent sides of the lower ring 30 and the housing 20 and which are held in engagement by the axial force exerted by the O-ring 32. This set of buttress and ramp shaped teeth 38 prevents the lower ring 30 from being rotated in a clockwise direction, as seen from the top of the fuze, but allows the lower ring 30 to be continuously rotated in a counterclockwise direction to 16 positions or settings. The outer surface 40 of the lower ring 30 also carries a series of 16 numbers, from 0 to 15, which are disposed about the periphery of the lower ring 30 such that, at each setting of the lower ring 30, one of these numbers 0–15 is aligned with an indication mark 42 on the outer surface of the housing 20 adjacent the lower ring 30.

The upper setting ring 28 is interconnected with the lower setting ring 30 by another set of buttress and ramp shaped teeth 44, which are disposed on adjacent facing sides of the two rings 28, 30, and which prevent the upper ring 28 from being rotated relative to the lower ring 30 in a counterclockwise direction, as seen from the top of the fuze, but allows the upper ring 28 to be rotated continuously in a clockwise direction relative to the lower ring 30 and the housing 20 to 10 positions or settings.

The outer surface 46 of the upper ring 28 also carries a series of 10 numbers, ranging from 0 to 9, which are disposed about the upper ring 28 so that one of these numbers 0–9 is aligned with the indication mark 42 on the housing 20 at each setting of the upper ring 28. Also, this series of numbers 0–9 is laterally orientated in the same direction as the series of numbers 0–15 on the lower ring 30 so that, at each combination of settings of the upper and lower rings 28, 30, the numbers on these two rings aligned with the indication mark 42 can be read as a single numerical value, in standard decimal format, which corresponds to a desired timing value in seconds to be encoded to the fuze.

The setting rings 28, 30 are axially biased and interconnected together and with the housing 20 so that the desired timing value to be encoded to the fuze can be quickly and accurately set and displayed in standard decimal format by manually rotating only the upper ring 28. When the upper ring 28 is rotated against the restraining force exerted by the O-ring 32 in a counterclockwise direction, as seen from the top of the fuze, the set of buttress and ramp shaped teeth 44 causes the lower ring 30 to be rotated with the upper ring 28. However, when the upper ring 28 is rotated in a clockwise direction, as seen from the top of the fuze, the lower ring 30 is prevented from rotating with the upper ring 28 by the set of buttress and ramp shaped teeth 38. Thus, the upper ring 38 is rotated first in a counterclockwise direction to set the lower ring 30, then in a clockwise direction to set the upper ring 28. Since only the upper ring 28 needs to be rotated to set the timing value, the height of the outer surface 40 of the lower ring 30 is made as small as possible and still carry the series of numbers 0–15. The height of the outer surface 46 of the upper ring 28 is made relatively large, and includes a plurality of indentations 48 about its periphery, in order to make it easy for this upper ring 28 to be gripped and turned during the setting operation; thus, the operator interface appears as a large single ring.

The inner surface 50 of the upper ring 28 is of approximately the same height as the inner surface 52 of the lower ring 30, and includes an inwardly-projecting bar member 54. The inner surface 52 of the lower ring 30 includes a similar inwardly-projecting vertical bar member 56.

A ring-type binary coded membrane switch assembly 58 is disposed on the housing 20 within the annular recess 26 beneath the setting rings 28, 30. At each combination of settings of the rings 28, 30, the bar members 54, 56 depress adjacent membrane switches of the switch tape 58 to thereby short (or open) switches to a ground channel 60 at appropriate code positions. The switch tape 58 is backed by a soft rubber layer 62 to provide a proper mechanical interface.

Figure 3:
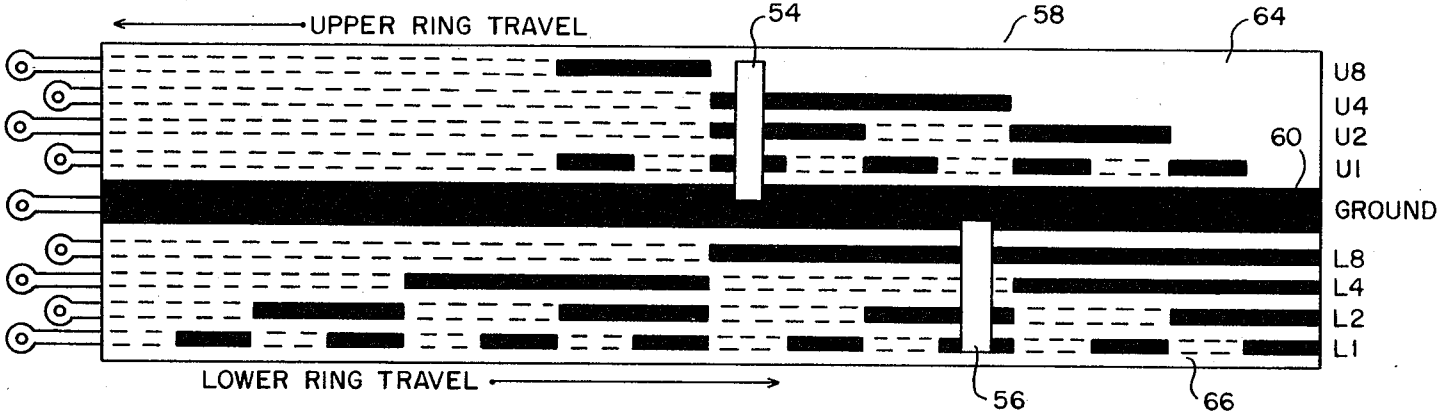
FIG. 3 is a schematic of a binary-coded switch tape actuated by the setting rings shown in FIG. 2.

As shown in FIG. 3, the switch tape 58 comprises an upper, 4-bit binary code 64 which is actuated by the upper ring bar member 54, and a lower, 16 position 4-bit binary code 66 which is actuated by the lower ring bar member 56. The upper bar member 54 actuates the upper code 64 to provide a 4-bit binary code to the electronic fuze corresponding to the number on the outer surface 46 of the upper ring 28 adjacent the indication mark 42. Similarly, the bar member 56 actuates the lower code 66 to provide a 4-bit binary code to the electronic fuze corresponding to the number on the outer surface of the lower ring 30 adjacent the indication mark 42. In FIG. 3, the upper and lower bar members 54, 56 are set to provide binary codes corresponding to the numbers 7 and 11, respectively. During operation of the fuze, the two encoded 4-bit binary codes are processed by conventional circuitry to provide a time delay corresponding to the displayed time setting, that is, a time delay which is equal, in seconds, to the number on the upper setting ring 28 adjacent the indication mark 42 plus the number on the lower setting ring 30 adjacent the indication mark 42 times ten. For example, the two 4-bit binary codes could be loaded into two cascaded counters in a timing circuit of the fuze, which are arranged so that the first counter counts in one second intervals and the second counter counts in 10 second intervals, the 4-bit binary code corresponding to the indicated upper ring number being loaded into the first counter and the 4-bit binary code corresponding to the indicated lower ring number being loaded in the second counter.

The use of two parallel codes in place of a single code allows the code setting increments to be 10 times wider than they would be for a single code system. For example, in another embodiment of the invention, the large increase in resolution provided by two setting rings and codes allows the time settings for a precision electronic time fuze to be set from 0 to 200 seconds in 0.1 second increments. In this embodiment, parallel 5-bit, 20 position and 7-bit, 100 position membrane switches are used to achieve settings from 0 to 199.9 seconds by multiplying the left switch setting by 10 and adding the setting of the right switch ring.

In the preferred embodiment described above and shown in the drawings, the set of buttress and ramp shaped teeth 38 include 16 teeth. Thus, the lower setting ring 30 is limited to 16 physical positions corresponding respectively to the 16 settings of this ring. However, the number of teeth 38 can be any multiple of the number of positions of the ring 30. For example, if the set of buttress and ramp shaped teeth 38 included 80 teeth, this would not only give greater locking force, but it would also allow greater setting alignment errors, since any of five positions centered on a given number would result in the selection of the code for that number.

There are many variations and modifications of the invention which would be obvious to one skilled in the art. For example, the time setting could be encoded as an analog value, rather than a binary code value. In such a case, the setting ring bar members 54, 56 could be used to short portions of two tapped resistances connected in series across a constant voltage source, to thus provide a voltage which is proportional to the indicated time setting.

Since there are many modifications, variations, and additions to the specific embodiment of the invention described herein which would be obvious to one skilled in the art, it is intended that the scope of the invention be limited only by the appended claims.

What is claimed and desired to be secured by Letters Patent of the United States is:

1. A system for manually setting a numerical value to be encoded to an electronic device having a housing which includes an axis and an external surface extending symmetrically about the axis, and displaying said numerical value adjacent an indication mark on the external surface of the housing, comprising:

a first setting ring which is disposed about the housing and is interconnected with the housing to be manually rotatable about the housing axis in at least one direction of rotation against a restraining force to a plurality of predetermined positions or settings, said first ring having an outer surface which includes a plurality of first numbers in standard decimal format corresponding to said plurality of first ring settings, said plurality of first numbers being disposed so that one of said first numbers is axially aligned with said indication mark at each first ring setting, said plurality of first numbers ranging from a minimum number to a maximum number in equal first increments of 1;

a second setting ring which is disposed about the housing adjacent and parallel to said first ring and which is interconnected with the housing to be manually rotatable about the housing axis in at least one direction of rotation against a restraining force to a plurality of predetermined positions or settings, said second ring having an outer surface which includes a plurality of second numbers corresponding to said plurality of second ring settings, said plurality of second numbers being disposed so that one of said second numbers is axially aligned with said indication mark at each second ring setting, said plurality of first numbers and said plurality of second numbers being oriented in a common lateral direction with the first numbers being disposed to the right of the second numbers so that the combination of first and second numbers aligned with the indication mark at each combination of first and second ring settings constitutes said numerical value to be encoded to the electronic device, the first number constituting a first or more significant portion of the numerical value and the second number constituting a second or less significant portion of the numerical value, said plurality of second numbers ranging from zero to a maximum number in equal second increments such that the indicated numerical value can be manually adjusted in equal increments from a minimum value to a maximum value, with the total number of selectable numerical values being equal to the number of first ring settings times the number of second ring settings; and encoding means, actuated by said first and second rings, for encoding the indicated numerical value to the electronic device.

2. A system, as described in claim 1, wherein said electronic device is an electronic fuze for an artillery missile, and said numerical value encoded to the electronic fuze is an event timing value which is set prior to firing of the missile.

3. A system, as described in claim 1, wherein said plurality of second numbers are set forth in standard decimal format, whereby said numerical value encoded to the electronic device is displayed in standard decimal format.

4. A system, as described in claim 1, wherein:

said first setting ring comprises an inner surface which includes a first inwardly-projecting axially-extending bar member;

said second setting ring comprises an inner surface which includes a second inwardly-projecting axially-extending bar member; and said encoding means comprises a first ring-type membrane switch means, disposed between the first setting ring and the housing and actuated by said first bar member, for supplying a first code to said electronic device corresponding to the displayed first number aligned with said indication mark, and a second ring-type membrane switch means, disposed between the second setting ring and the housing and actuated by said second bar member, for supplying a second code to said electronic device corresponding to the displayed second number aligned with said indication mark.

5. A system, as described in claim 1, which further comprises:

first interconnecting means for interconnecting one of said first and second rings with said housing to allow the continuous rotation of said one ring with respect to the housing in one direction of rotation while preventing the continuous rotation of said one ring with respect to the housing in an opposite direction of rotation; and second interconnecting means for interconnecting the other ring of said first and second rings with said one ring to allow the continuous rotation of said other ring with respect to said one ring in said opposite direction of rotation while preventing the continuous rotation of said other ring with respect to said one ring in said one direction of rotation;

whereby when said other ring is rotated in said one direction of rotation with respect to the housing, said second interconnecting means causes said one ring to be rotated with said other ring, and when said other ring is rotated in said opposite direction of rotation with respect to the housing, said first interconnecting means prevents the rotation of said one ring with said other ring.

6. A system, as described in claim 5, wherein:

the exterior surface of the housing includes an annular recess or groove in which the first and second setting rings are disposed, said recess including resilient means for exerting a force on the rings in one axial direction to engage one side of said one ring against one side of said recess and to engage one side of said other ring against the other side of said one ring;

said first interconnecting means comprises buttress and ramp shaped teeth on the engaged sides of said one ring and said recess;

said second interconnecting means comprises buttress and ramp shaped teeth on the engaged side of the two rings.

7. A system, as described in claim 6, wherein:

said electronic device is an artillery fuze;

the outer surface of the first and second rings are substantially flush with the axially adjacent surface of the fuze housing; and the outer surface of said other ring is substantially wider than the outer surface of said one ring, to thus facilitate setting of the numerical value encoded to the fuze by the manual rotation of said other ring, said other ring being rotated first in said one direction of rotation to set said one ring, then in said opposite direction of rotation to set said other ring.

* * * * *